US006173779B1

(12) United States Patent
Smith

(10) Patent No.: US 6,173,779 B1
(45) Date of Patent: Jan. 16, 2001

(54) COLLAPSIBLE WELL PERFORATING APPARATUS

(75) Inventor: Ian W. Smith, Aberdeen (GB)

(73) Assignee: Halliburton Energy Services, Inc., Dallas, TX (US)

( * ) Notice: Under 35 U.S.C. 154(b), the term of this patent shall be extended for 0 days.

(21) Appl. No.: 09/039,880

(22) Filed: Mar. 16, 1998

(51) Int. Cl.[7] ..... E21B 43/119

(52) U.S. Cl. ..... 166/297; 166/55.1; 166/242.6; 166/376

(58) Field of Search ..... 166/297, 55.1, 166/242.1, 242.2, 242.6, 298, 376

(56) References Cited

U.S. PATENT DOCUMENTS

| | | | | |
|---|---|---|---|---|
| 2,853,944 | | 9/1958 | Robertson | 175/4.6 |
| 3,211,093 | * | 10/1965 | McCullough et al. | 175/4.6 |
| 3,923,105 | * | 12/1975 | Lands, Jr. | 175/4.55 |
| 3,923,106 | * | 12/1975 | Bosse-Platiere | 175/4.55 |
| 4,375,834 | | 3/1983 | Trott | 166/297 |
| 4,612,992 | | 9/1986 | Vann et al. | 166/297 |
| 4,619,333 | | 10/1986 | George | 175/4.52 |
| 4,694,878 | | 9/1987 | Gambertoglio | 166/377 |
| 4,790,383 | | 12/1988 | Savage et al. | 166/297 |
| 4,905,759 | | 3/1990 | Wesson et al. | 166/55 |
| 5,025,861 | | 6/1991 | Huber et al. | 166/297 |
| 5,156,213 | | 10/1992 | George et al. | 166/297 |
| 5,366,014 | | 11/1994 | George | 166/297 |
| 5,398,760 | | 3/1995 | George et al. | 166/297 |
| 5,603,379 | | 2/1997 | Henke et al. | 166/297 |

* cited by examiner

*Primary Examiner*—George Suchfield
(74) *Attorney, Agent, or Firm*—Paul I. Herman; E. Harrison Gilbert, III

(57) ABSTRACT

A well perforating apparatus has a first perforating gun section, a second perforating gun section, and a longitudinally collapsible unitary section connected between the first and second perforating gun sections. The unitary section can include a deformable member, or a frangible member, or a flexible member. One specific such member is a cable, such as implemented with a length of wireline material or slickline material. In a method of perforating a well having a plurality of zones to be perforated, a well perforating apparatus is lowered into the well. This includes separating a first perforating gun section from a second perforating gun section such that one gun section is adjacent one zone to be perforated and such that the other perforating gun section is adjacent another zone to be perforated. Separating the first perforating gun section from the second perforating gun section includes connecting a longitudinally deformable or flexible unitary member having no operating components between the first and second perforating gun sections. The well perforating apparatus is actuated to operate one or more of the first and second perforating gun sections, and then the well perforating apparatus is released to fall into a rathole of the well. This method also includes longitudinally collapsing the well perforating apparatus at the deformable or flexible unitary member.

23 Claims, 2 Drawing Sheets

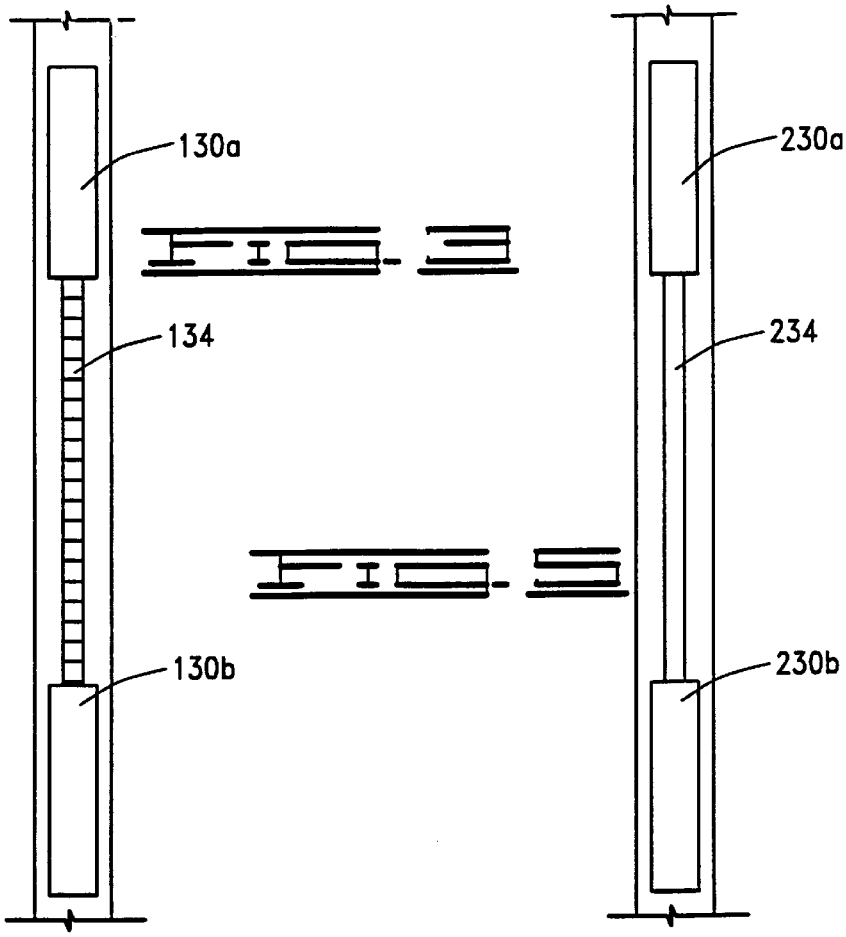
FIG. 3
FIG. 5
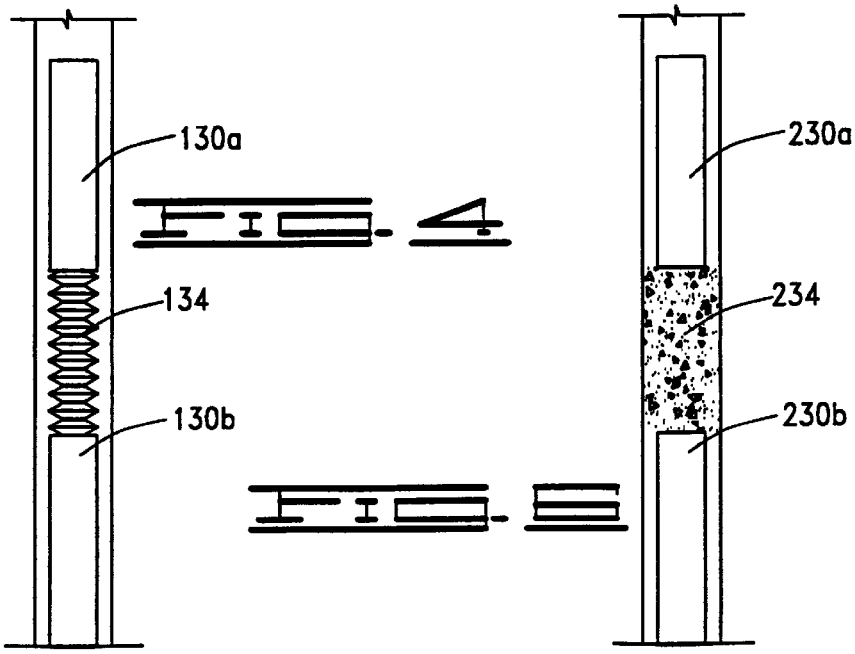
FIG. 4
FIG. 6

COLLAPSIBLE WELL PERFORATING APPARATUS

BACKGROUND OF THE INVENTION

This invention relates generally to apparatus and methods for perforating wells, especially oil or gas wells. The invention more particularly relates to such apparatus and methods in which multiple perforating gun sections are put in the well at one time and released to fall to the bottom of the well after the perforating operation. In its preferred implementation, the invention incorporates a longitudinally deformable or flexible unitary member.

In completing an oil or gas well, a perforation operation is frequently used to open passageways for oil or gas in a subterranean formation or zone to flow into the borehole and up to the surface. Explosive charges are detonated to generate high pressure jets that create the perforations.

Tubing conveyed perforating systems to accomplish the foregoing can be conveyed into wells on a tubing or pipe string with the string left in position in the well during the perforating of the well. Such systems include one or more devices which carry the explosive charges. These devices are referred to as perforating guns. After perforating the well, the perforating guns may have disintegrated or may be retrieved, or they may be released or dropped from the tubing or pipe string through the use of various techniques.

One such technique is an automatically releasing gun hanger which has been proposed as shown in U.S. Pat. No. 5,156,213 to George et al. The George et al. '213 patent describes an automatically releasing gun hanger which is run into the well on a rigid tubing string or pipe string. The gun hanger is set within the well by a rotating motion of the rigid tubing string or pipe string. Through further rotational motion, the rigid tubing string or pipe string is then disconnected from the perforating gun attached to the gun hanger. The tubing or pipe string can then be removed from the well. The perforating gun is fired by a pressure actuated firing head. Upon firing of the perforating gun, the gun hanger automatically releases, thus allowing the gun to drop to the bottom of the well.

It has also been proposed to run the perforating gun into the well on a coiled tubing string. In such cases, rotation of the string as with a rigid tubing string or pipe string is not possible. U.S. Pat. No. 5,398,760 to George et al. discloses a modified version of the apparatus shown in the George et al. '213 patent. In this modified version, the actuating mechanism of the gun hanger is such that it is operated by a simple reciprocating motion of the coiled tubing string without the need for any rotating motion. Also, a pressure responsive release mechanism connects the coiled tubing string to the perforating gun so that after the gun hanger is set within the casing, pressure within the coiled tubing string may be increased to release the coiled tubing string from the perforating gun, thus allowing the coiled tubing string to be retrieved prior to firing the perforating gun.

While both of the previously described apparatus work well, in some situations problems may occur. For example, when there is an insufficient "rathole" in the bottom of the well into which to drop the entire perforating gun assembly, a portion of the gun assembly may interfere with flow of fluids from the perforated formation. The potential for this problem may be especially present with perforating systems using longitudinally spaced perforating gun sections such as described in U.S. Pat. No. 4,612,992 to Vann et al. and U.S. Pat. No. 4,619,333 to George. One possible solution to this is to provide selectably retrievable gun sections. U.S. Pat. No. 5,366,014 to George describes a modular gun system in which only the sections that remain across the perforations after firing need to be retrieved.

To avoid the need to retrieve gun sections, which can be time consuming and costly, preferably the portion released to the bottom of the well can be collapsed such that it does not interfere with the perforations even when there is limited rathole height below the perforations. Proposals for this type of solution are set forth in U.S. Pat. No. 4,790,383 to Savage et al. and U.S. Pat. No. 4,905,759 to Wesson et al. These patents disclose multiple-component, operating mechanical structures which undergo telescoping movement of one portion relative to another portion. It would be desirable if a simpler interconnecting structure could be provided to avoid shortcomings which might exist with such a multi-component, telescoping movement structure. A simpler, less complicated structure should result in fewer failures and thus be more reliable. Such a simple structure should also preferably better accommodate shallower ratholes by providing a shorter collapsed profile than a multi-component, telescoping structure.

SUMMARY OF THE INVENTION

The present invention overcomes the above-noted and other shortcomings of the prior art by providing a novel and improved collapsible well perforating apparatus and method. The present invention enables the well perforating apparatus to be released into the rathole of the well after the perforating operation, thereby obviating the need for a potentially time consuming and costly retrieval procedure. The present invention further enables such release to be used even in a well having a limited rathole height below the perforations. Such advantages are achieved by using a simple interconnecting structure which requires no mechanical operation other than structural collapse. The simple design of the interconnecting structure uses minimal parts, thus there is less to go wrong, thereby enhancing reliability. This invention can significantly reduce, if not virtually eliminate, spacer sections when the apparatus is dropped into the rathole; and, yet, the invention allows for the perforation of multiple sections in the well.

The well perforating apparatus of the present invention comprises: a first perforating gun section; a second perforating gun section; and a longitudinally collapsible unitary section connected between the first and second perforating gun sections. This unitary section can be defined as a longitudinally deformable or flexible member having no operating components (i.e., no operation other than the inherent structural functions of providing a spacing length before perforating gun detonation and of collapsing after detonation). More particularly, this last element includes a deformable member, or a frangible member, or a flexible member. One specific such member is a cable, such as implemented with a length of wireline material or slickline material.

The present invention also provides a method of perforating a well having a plurality of zones to be perforated. This method comprises lowering a well perforating apparatus into the well, including separating a first perforating gun section from a second perforating gun section such that the first perforating gun section is adjacent one zone to be perforated and such that the second perforating gun section is adjacent another zone to be perforated, which separating the first perforating gun section from the second perforating gun section includes connecting a longitudinally deformable or flexible unitary member between the first and second perforating gun sections. This method further comprises: actuating the well perforating apparatus to operate one or more of the first and second perforating gun sections; releasing the well perforating apparatus to fall into a rathole of the well; and longitudinally collapsing the well perforating apparatus at the deformable or flexible unitary member.

Therefore, from the foregoing, it is a general object of the present invention to provide a novel and improved collapsible well perforating apparatus and method. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 3 is a diagrammatic illustration of a well in which another embodiment of the well perforating apparatus of the present invention is disposed prior to a perforating operation.

FIG. 4 is a diagrammatic illustration showing the embodiment of FIG. 3 in the rathole of the well after perforating the well and releasing the well perforating apparatus.

FIG. 5 is a diagrammatic illustration of a well in which still another embodiment of the well perforating apparatus of the present invention is disposed prior to a perforating operation.

FIG. 6 is a diagrammatic illustration showing the embodiment of FIG. 5 in the rathole of the well after perforating the well and releasing the well perforating apparatus.

DETAILED DESCRIPTION OF THE INVENTION

Figure 1:
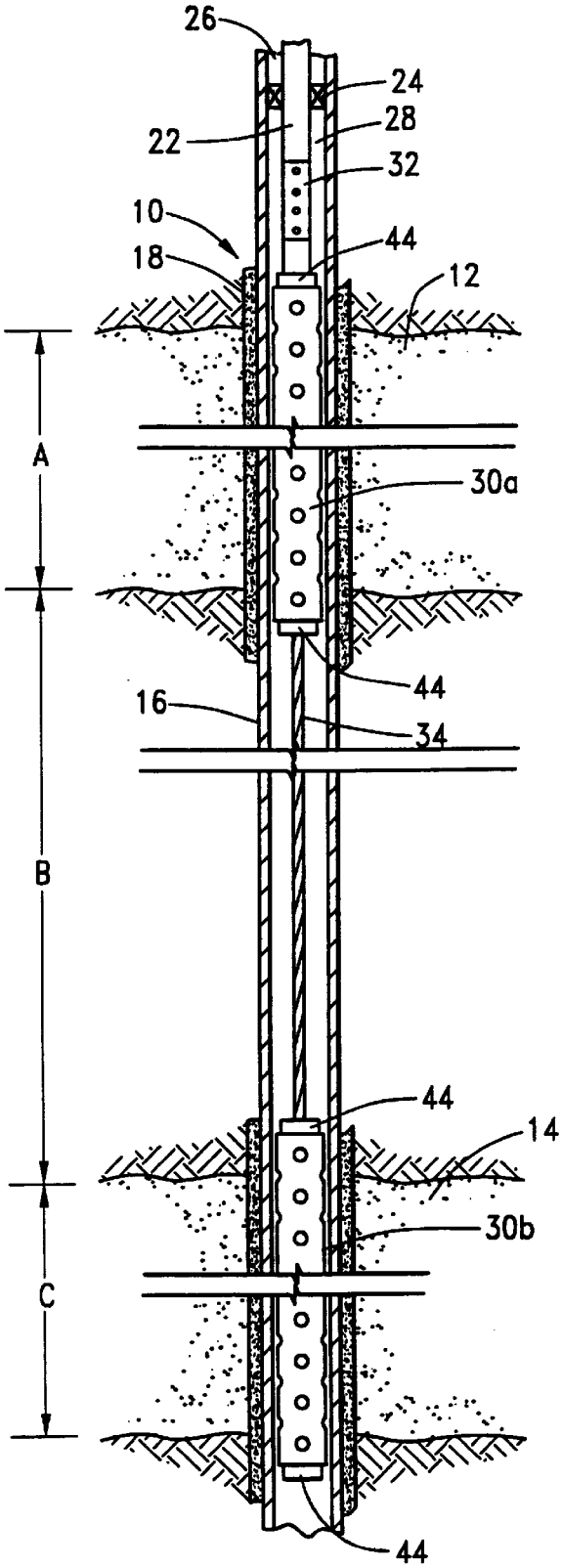
FIG. 1 is a diagrammatic illustration of a well in which an embodiment of the well perforating apparatus of the present invention is disposed prior to a perforating operation.

Referring initially to FIG. 1, there is disclosed a typical oil or gas well having borehole 10 extending downhole from the surface of the ground (not shown) through a first or upper hydrocarbon-containing formation 12 and through a second or lower hydrocarbon-containing formation 14. The borehole 10 is cased by a string of casing 16 which is cemented into the borehole 10 as shown at 18. A string of pipe 22, such as production tubing or drill pipe or coiled tubing, is suspended within casing 16 and extends from the surface axially through casing 16. String 22 within casing 16 forms a borehole annulus. A packer 24, disposed on string 22, divides the borehole annulus into upper annulus 26 and lower annulus 28.

Figure 2:
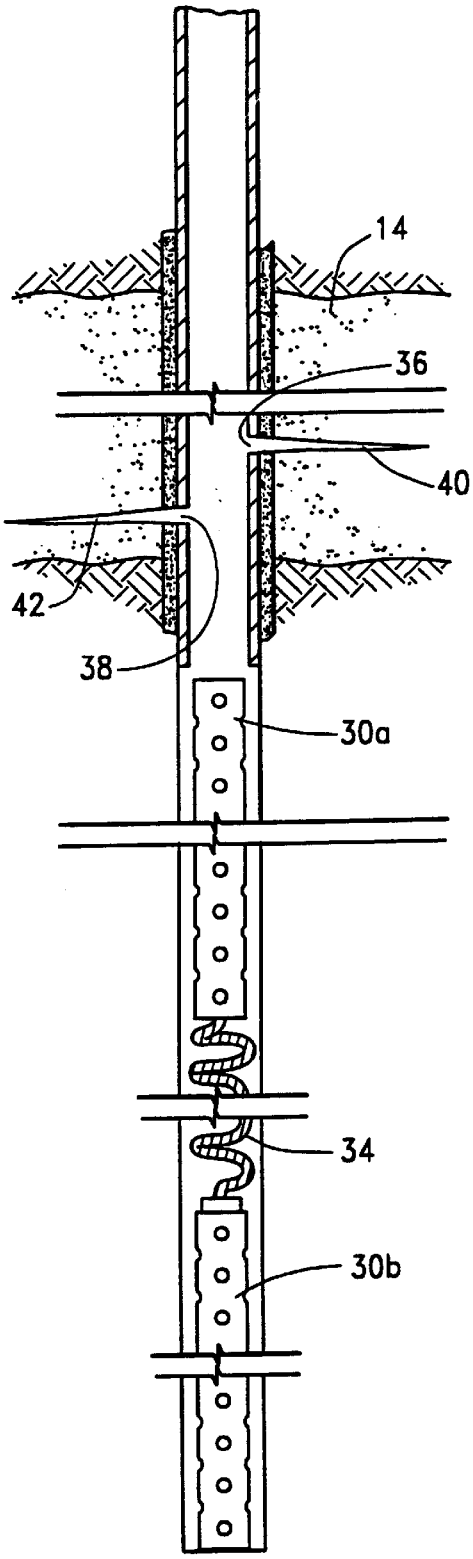
FIG. 2 is a diagrammatic illustration showing the embodiment of FIG. 1 in the rathole of the well after perforating the well and releasing the well perforating apparatus.

To complete the well or test the formations, it is necessary to access the hydrocarbons in formation 12 and/or formation 14 with that portion of the annulus extending below packer 24, i.e., lower annulus 28. This is accomplished, for example, by supporting one or more perforating gun sections 30 from a perforated nipple 32 near the lower end of string 22. Perforating gun section 30*a* supports a connector or spacer section 34 of a predetermined length which in turn supports a perforating gun section 30*b*. For purposes of this description, these first and second perforating gun sections 30*a*, 30*b* will be limited to one perforating gun each, but additional guns can be included as can additional sections 30. The perforating guns are of any suitable type known. One example is a jet casing gun but any device for communicating the hydrocarbon-containing formations 12, 14 with annulus 28 can be used. The jet perforating gun of the casing type shoots metallic particles into the formations 12, 14 to form, for example, perforations 36, 38 and corresponding channels or tunnels 40, 42 (FIG. 2).

During the drilling of the borehole 10, the formation pressures are controlled by weighted drilling fluid, filtrate and perhaps fines which invade the formation, interacting with in situ solids and fluids to create contaminated zones, reducing permeability, and leaving on the face of formations 12, 14 a low-permeability filter cake. The cementing operation also includes fluids and fines which invade and damage formations 12, 14 at the contaminated zones. Thus, the perforating guns must penetrate deeply into formations 12, 14 to form tunnels (e.g., 40, 42) that pass through casing 16, cement 18, and contaminated zones and into the uncontaminated or sterile zones of formations 12, 14. Exemplified perforations 36, 38 and tunnels 40, 42 form the final passageways which enable the hydrocarbons to flow from formations 12, 14 into lower annulus 28 for movement to the surface through the string 22 or a subsequent string if the former has been removed (e.g., through use of an automatic release gun hanger).

The perforating sections 30 also include one or more suitable firing heads with which to detonate the perforating guns. There are various conventional types of firing heads, such as impact actuated, electrically actuated, etc., that can be used; however, the preferred embodiments illustrated in the drawings are conventional pressure actuated types. Preferably two firing heads 44 are used for each gun section 30 as shown in the drawings and as known in the art. The pressure actuated firing heads can be of any suitable type. Specific examples include rupture disk and shear pin devices with respective pressure tolerances as known in the art.

Still referring to FIG. 1, upper formation 12 and lower formation 14 each have vertical depths A and C, respectively, as marked in FIG. 1. The distance between formations 12 and 14 is marked as B, which may be between a few feet and several hundred feet, for example. The connector section 34 of the present invention is used to span this distance B and thereby space the perforating gun sections 30*a*, 30*b* the desired distance that places these sections adjacent the respective formations or zones to be perforated.

The connector 34 of the present invention includes any unitary longitudinally collapsible section connected between the perforating gun sections 30*a*, 30*b*. It is noted that the collapsible section can span the entire interconnection distance or only a part of the distance. With regard to the latter, other connecting segments can be used as known in the art (e.g. rigid pipe elements). It is a specific aspect of the unitary collapsible section defining the connector 34 of the present invention that it contain no operating component such as found in prior art telescoping interconnecting assemblies. The operation of the connector 34 of the present invention is limited to (1) maintaining its predetermined spacing and length prior to perforation and (2) structurally collapsing as described below. This is important because it provides in the present invention a simplified structure which is not susceptible to mechanical malfunction.

The connector 34 of the present invention specifically includes a flexible unitary member or a deformable unitary member. The deformable unitary member includes either a plastically deformable or a catastrophically deformable, or frangible, member. Each of these will be described with regard to FIGS. 1 and 2, 3 and 4, and 5 and 6, respectively.

Referring to FIGS. 1 and 2, the connector 34 includes a flexible member such as a cable. Specific implementations can be with materials used for wireline cables or slickline cables known in the art. The specific nature of any such cable depends on the size and weight of the gun sections to be supported. Such details can be readily determined by those skilled in the art. Non-limiting examples include a multi-stranded wire cable or a composite cable (e.g., a lightweight, small diameter, high tensile strength carbon fiber composition). In general, a smaller diameter and more flexibility will increase the ability of the cable to collapse, or coil, as illustrated in FIG. 2; however, necessary design criteria (e.g., the strength and length/spacing) must still be met. In one implementation, such a cable is connected to the firing heads by wireline clamp cross-overs known in the art.

Referring to FIGS. 3 and 4, the same arrangement as illustrated in FIGS. 1 and 2 is shown except that the connector 134 connected between the perforating gun sections 130*a*, 130*b* is a plastically deformable member 134. This can be, for example, a thin wall tubular structure made of a suitable metal or polymer or composite type material which undergoes plastic deformation. As illustrated in FIGS. 3 and 4, the member 134 can include lines of weakness which facilitate longitudinal collapse in the "accordion" fashion represented in FIG. 4. To prevent lateral or radial collapse if the member 134 is hollow, the member 134 can have openings through its side wall to allow pressure equalization. The longitudinal collapse can occur in response either to actuation (firing) of the guns of the sections 130*a*, 130*b* or to impact of the released well perforating apparatus in the rathole. The member 134 can be connected to the adjacent components of the apparatus by any suitable coupling technique. A non-limiting example is by a screw connection wherein a screw coupling thread is formed in the plastically deformable member at each end.

Referring to FIGS. 5 and 6, a third embodiment of the connector 34 of the present invention is illustrated. The well perforating apparatus of this embodiment includes perforating gun sections 230*a*, 230*b* the same as in the previously described embodiments; however, this embodiment of the well perforating apparatus includes a frangible member 234 connected between the perforating gun sections 230*a*, 230*b*. The frangible member 234 is any suitable unitary structure made of an appropriate material which will undergo catastrophic failure when the well perforating apparatus is actuated or impacts the rathole as illustrated in FIG. 6. Suitable materials include but are not limited to ceramics and composite materials, including glass fiber materials (e.g., glass reinforced plastic (GRP)). The frangible member couples within the apparatus in any suitable manner. One example is by a threaded connection with a thread formed on each end of the member 234.

Any one of the foregoing embodiments of the well perforating apparatus can be used in the method of the present invention. This method comprises lowering a well perforating apparatus of the type described into the well to be perforated. The act of lowering is performed in a known manner. This step of lowering also includes separating a first perforating gun section from a second perforating gun section such that the first perforating gun section is adjacent one zone to be perforated and such that the second perforating section is adjacent another zone to be perforated once the apparatus has been lowered to the desired position. Separating the two gun sections includes connecting, in a suitable manner such as described above, a deformable or flexible unitary member between the two gun sections. If the unitary member is not rigid, it can be maintained in its elongated length by the weight of the lower perforating gun(s). The deformable or flexible unitary member is of the type described above wherein the member itself preferably has no operating components, thereby distinguishing the present invention from a multi-component, telescoping apparatus, for example. The member of the present invention does, however, function via its inherent unitary construction to provide desired spacing between perforating gun sections and to structurally collapse upon detonation or impact in the rathole.

The method of the present invention further comprises actuating the well perforating apparatus to operate one or more of the perforating gun sections. This is done in known manner. Once this has been performed, the well perforating apparatus is released to fall into a rathole of the well. The well perforating apparatus can be released in any suitable manner. Examples include using a mechanical, pressure, or automatic tubing release assembly of types known in the art. Selective release can also be accomplished, such as by using a modified automatic release assembly and select fire subs of types known in the art. In one type of selective release, a modified automatic release at the base of a perforating gun section has (1) a top connected to the gun (explosive connection) and (2) a bottom connected to the longitudinally collapsible unitary member.

The method of present invention still further comprises collapsing the well perforating apparatus at the deformable or flexible unitary member. This occurs either in response to the force caused by the detonated perforating guns or in response to the force of the released well perforating apparatus impacting the rathole. This also preferably occurs such that the resulting length of the collapsed well perforating apparatus is not greater than the height of the well's rathole below the lowermost perforations. The foregoing is illustrated in FIGS. 2, 4 and 6 described above.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A well perforating apparatus, comprising:

a first perforating gun section;

a second perforating gun section; and a longitudinally collapsible unitary section connected between the first and second perforating gun sections, wherein the gun sections are able to fall together.

2. A well perforating apparatus as defined in claim 1, wherein the longitudinally collapsible unitary section includes a deformable member.

3. A well perforating apparatus as defined in claim 1, wherein the longitudinally collapsible unitary section includes a frangible member.

4. A well perforating apparatus as defined in claim 1, wherein the longitudinally collapsible unitary section includes a flexible member.

5. A well perforating apparatus as defined in claim 1, wherein the longitudinally collapsible unitary section includes a cable.

6. A well perforating apparatus as defined in claim 1, wherein the longitudinally collapsible unitary section consists of a deformable member.

7. A well perforating apparatus as defined in claim 1, wherein the longitudinally collapsible unitary section consists of a frangible member.

8. A well perforating apparatus as defined in claim 1, wherein the longitudinally collapsible unitary section consists of a flexible member.

9. A well perforating apparatus as defined in claim 1, wherein the longitudinally collapsible unitary section consists of a cable.

10. A well perforating apparatus, comprising:

a first perforating gun section;

a second perforating gun section; and a longitudinally collapsible member having no operating components, the longitudinally collapsible member connected between the first and second perforating gun sections such that the collapsible member collapses, and spacing between the first and second perforating gun sections decreases, upon detonation of the gun sections or impact of the gun sections in the well below where the gun sections are detonated.

11. A well perforating apparatus as defined in claim 10, wherein the collapsible member is a cable.

12. A well perforating apparatus as defined in claim 10, wherein the collapsible member is a wireline cable.

13. A well perforating apparatus as defined in claim 10, wherein the collapsible member is a slickline cable.

14. A method of perforating a well having a plurality of zones to be perforated, comprising:

lowering a well perforating apparatus into the well, including separating a first perforating gun section from a second perforating gun section such that the first perforating gun section is adjacent one zone to be perforated and such that the second perforating gun section is adjacent another zone to be perforated, which separating the first perforating gun section from the second perforating gun section includes connecting a longitudinally collapsible unitary member between the first and second perforating gun sections;

actuating the well perforating apparatus to operate one or more of the first and second perforating gun sections;

releasing the well perforating apparatus to fall into a rathole of the well; and longitudinally collapsing the well perforating apparatus at the collapsible unitary member.

15. A method as defined in claim 14, wherein the collapsible unitary member is a cable.

16. A method as defined in claim 14, wherein the collapsible unitary member is a wireline cable.

17. A method as defined in claim 14, wherein the collapsible unitary member is a slickline cable.

18. A method as defined in claim 14, wherein the collapsible unitary member is flexible.

19. A method as defined in claim 14, wherein the collapsible unitary member is deformable.

20. A method as defined in claim 14, wherein the collapsible unitary member is frangible.

21. A well perforating apparatus as defined in claim 10, wherein the collapsible member is a flexible member.

22. A well perforating apparatus as defined in claim 10, wherein the collapsible member is a deformable member.

23. A well perforating apparatus as defined in claim 10, wherein the collapsible member is a frangible member.

* * * * *